US009610696B2

(12) United States Patent
Nordlin et al.

(10) Patent No.: US 9,610,696 B2
(45) Date of Patent: Apr. 4, 2017

(54) CLAMPING ASSEMBLY OF A KNOCKOUT PUNCH

(75) Inventors: William Nordlin, Poplar Grove, IL (US); Rodney Kramer, Rockford, IL (US)

(73) Assignee: TEXTRON INNOVATIONS INC., Providence, RI (US)

( * ) Notice: Subject to any disclaimer, the term of this patent is extended or adjusted under 35 U.S.C. 154(b) by 364 days.

(21) Appl. No.: 13/106,405

(22) Filed: May 12, 2011

(65) Prior Publication Data

US 2011/0277610 A1 Nov. 17, 2011

Related U.S. Application Data

(60) Provisional application No. 61/345,317, filed on May 17, 2010.

(51) Int. Cl.

| | |
|---|---|
| ***B26F 1/14*** | (2006.01) |
| ***B26F 1/36*** | (2006.01) |
| ***B21D 28/34*** | (2006.01) |
| ***B26D 7/26*** | (2006.01) |
| ***B26F 1/38*** | (2006.01) |

(52) U.S. Cl.

CPC ..... *B26F 1/386* (2013.01); *B21D 28/343* (2013.01); *B26D 7/26* (2013.01); *B26D 7/2614* (2013.01); *B26F 1/14* (2013.01); *B26F 1/3846* (2013.01); *Y10T 83/9425* (2015.04); *Y10T 83/9428* (2015.04); *Y10T 83/9435* (2015.04); *Y10T 83/9461* (2015.04); *Y10T 83/9476* (2015.04)

(58) Field of Classification Search

CPC ..... A61F 2005/4415; B21D 28/34; B21D 28/343; B21D 28/346; B23D 29/02; B26D 7/26; B26D 2007/2607; B26D 7/2614; B26D 7/2621; B26D 7/2628; B26D 7/2635; B26F 1/14; B26F 1/3846; B26F 1/386; B26F 1/3866; Y10T 83/9425; Y10T 83/9428; Y10T 83/9435; Y10T 83/9437; Y10T 83/9461; Y10T 83/9476

USPC .... 83/685, 686, 689, 690, 698.31, 123, 343, 83/346, 698.91; 81/321; 30/360, 361, 30/366

See application file for complete search history.

(56) References Cited

U.S. PATENT DOCUMENTS

| | | | | | |
|---|---|---|---|---|---|
| 869,802 | A | * | 10/1907 | Pearce | 81/76 |
| 2,221,904 | A | * | 11/1940 | Abramson et al. | 30/360 |
| 2,735,489 | A | * | 2/1956 | Fowler | 30/360 |
| 3,014,277 | A | * | 12/1961 | Geckler | 30/324 |
| 4,495,699 | A | * | 1/1985 | Oakes | 30/360 |
| 4,594,779 | A | * | 6/1986 | Hagemeyer | 30/360 |

(Continued)

*Primary Examiner* — Clark F Dexter

(74) *Attorney, Agent, or Firm* — Klintworth & Rozenblat IP LLC

(57) ABSTRACT

A clamping assembly includes a first jaw having a plurality of alternating grooves and lands formed thereon, a second jaw having a plurality of alternating grooves and lands formed thereon, and a spring provided between the first and second jaws. The jaws are pivotable relative to each other. The jaws are attached to a draw stud. The draw stud is formed from an elongated cylinder which has a conventional thread form formed on one end thereof and a plurality of alternating grooves and lands formed on the other end thereof. The alternating grooves and lands formed on the jaws mesh with the alternating grooves and lands formed on the draw stud to mate the jaws with the draw stud.

15 Claims, 6 Drawing Sheets

(56) References Cited

U.S. PATENT DOCUMENTS

| | | | | |
|---|---|---|---|---|
| 4,821,417 | A * | 4/1989 | Levine | 30/298 |
| 5,791,053 | A * | 8/1998 | Koong | 30/142 |
| 5,890,223 | A * | 4/1999 | Klemmer | 30/150 |
| 6,115,921 | A * | 9/2000 | Garneau, Sr. | 30/123 |
| 6,421,921 | B1 * | 7/2002 | Garneau, Sr. | 30/150 |
| 6,981,327 | B2 * | 1/2006 | Nordlin | 30/360 |
| 2002/0092181 | A1 * | 7/2002 | Choi | 30/324 |
| 2006/0175228 | A1 * | 8/2006 | Howel et al. | 206/751 |
| 2009/0019709 | A1 * | 1/2009 | Fisher et al. | 30/344 |
| 2010/0180744 | A1 * | 7/2010 | Nordlin | 83/686 |

* cited by examiner

CLAMPING ASSEMBLY OF A KNOCKOUT PUNCH

This application claims the domestic benefit of U.S. provisional application Ser. No. 61/345,317 filed on May 17, 2010, the disclosure of which is herein incorporated by reference in its entirety.

FIELD OF THE INVENTION

The invention relates to a clamping assembly for use with a knockout punch.

BACKGROUND OF THE INVENTION

Knockout punches are used routinely to create holes in thin layers of material such as the sheet metal found on electrical boxes. Knockout punches are used in conjunction with a draw stud, a ram, and a die which are all used to punch a hole.

The user drills a pilot hole approximately in the center of the area where the final hole needs to be located. The draw stud, which has been attached to the ram, has the die slid over its free end until the die abuts the ram. The draw stud is then inserted with its free end first through the pilot hole until the die is seated against one side of a sheet of material. The knockout punch, which has a central hole with internal threads, is screwed onto the free end of the draw stud which has complimentary-shaped external threads on it. This process continues until the knockout punch impinges onto the side of the sheet of material opposite the side on which the die is located. As a result, the sheet of material is snugly captured on both sides by the die and the punch. Finally, the ram is actuated such that the draw stud and knockout punch are drawn toward the ram, supplying sufficient force to the knockout punch to puncture and cut the sheet of material and produce the final hole.

The ram that is used is usually mechanically or hydraulically powered, but can be powered by other means. Overall, this device works well, however, the most time consuming task is screwing the knockout punch onto the draw stud, which can take as long as thirty to sixty seconds to accomplish depending on the length of the draw stud. Of course, this can be frustrating and inefficient for the user, especially when a great number of holes need to be punched. Accordingly, there has been a need to find a way to couple the knockout punch to the draw stud in a faster manner.

SUMMARY OF THE INVENTION

Briefly, a clamping assembly includes a first jaw having a plurality of alternating semi-annular grooves and lands formed thereon, a second jaw having a plurality of alternating semi-annular grooves and lands formed thereon, and a spring provided between the first and second jaws. The jaws are pivotable relative to each other. The jaws are attached to a draw stud. The draw stud is formed from an elongated cylinder which has a conventional thread form formed on one end thereof and a plurality of alternating annular grooves and lands formed on the other end thereof. The alternating semi-annular grooves and lands formed on the jaws mesh with the alternating annular grooves and lands formed on the draw stud to mate the jaws with the draw stud.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENT

Figure 1:
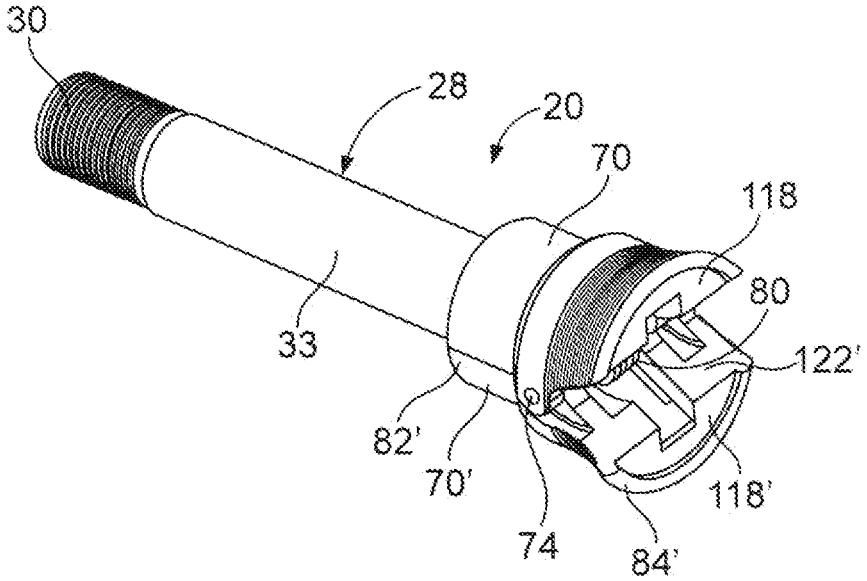
FIG. 1 is a perspective view of a clamping assembly which incorporates the features of the present invention and is mounted on a draw stud.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 5:
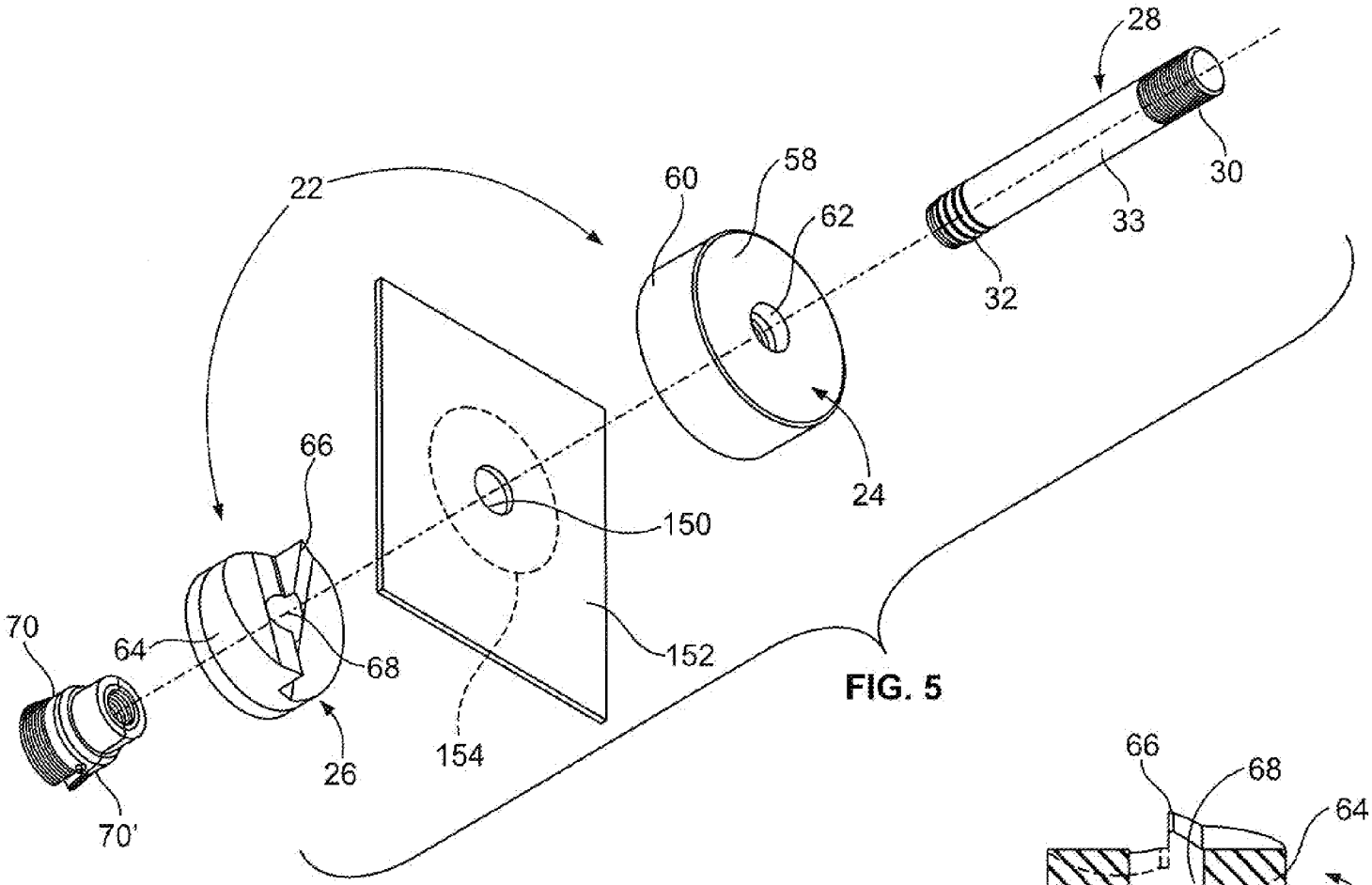
FIG. 5 is a perspective view of the draw stud, a workpiece, a die and a punch.
Figure 6:
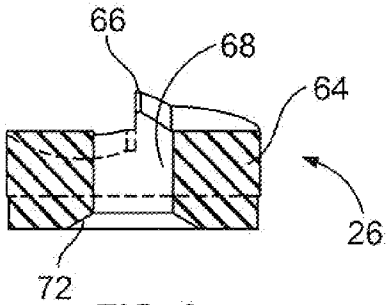
FIG. 6 is a cross-sectional view of the punch.
Figure 7:
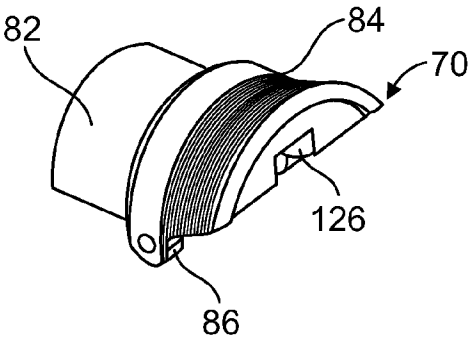
FIG. 7 is a perspective view of a jaw which forms part of the clamping assembly.
Figure 8:
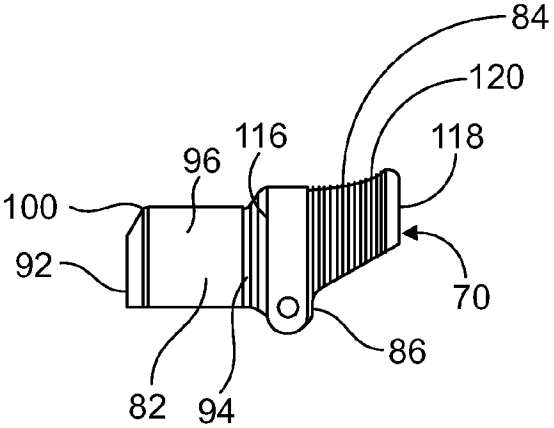
FIG. 8 is a side elevational view of the jaw.
Figure 9:
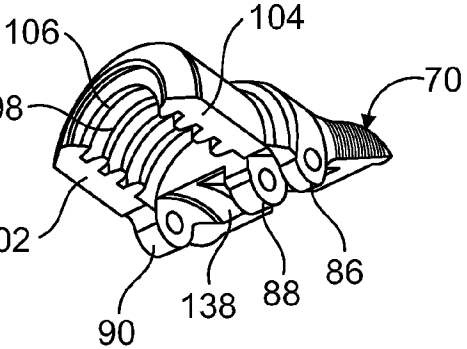
FIG. 9 is an alternate perspective view of the jaw.
Figure 10:
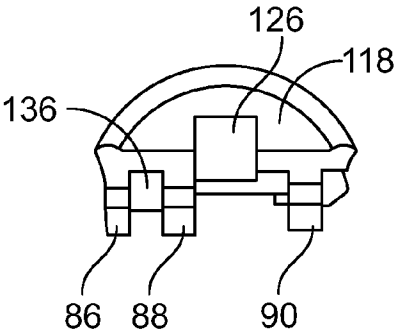
FIG. 10 is rear elevational view of the jaw.
Figure 11:
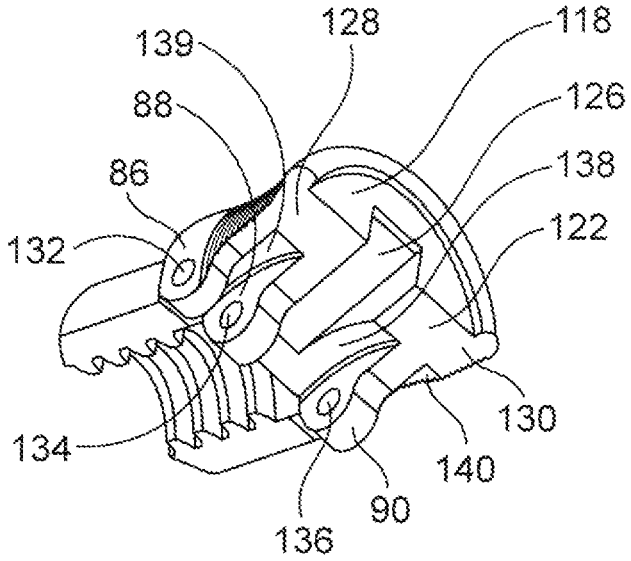
FIG. 11 is another alternate perspective view of the jaw.
Figure 12:
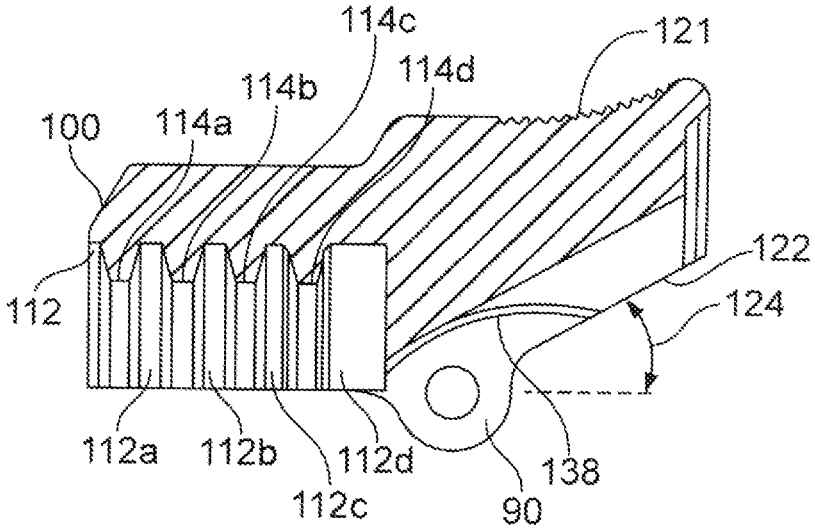
FIG. 12 is a cross-sectional view of the jaw.
Figure 14:
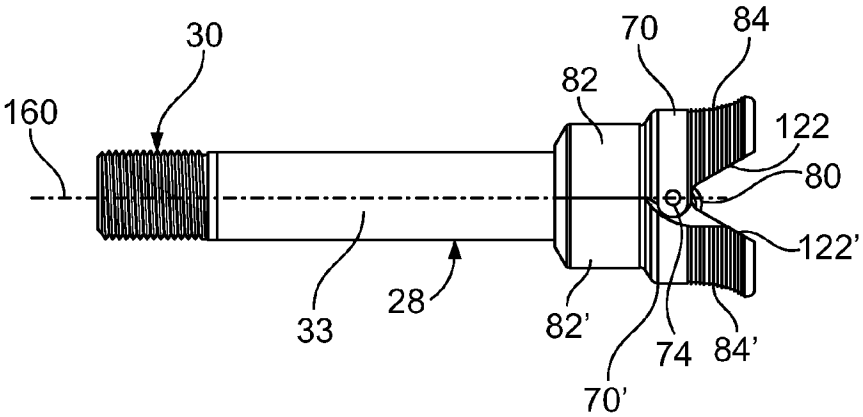
FIG. 14 is a side elevational view of the clamping assembly and the draw stud.
Figure 16:
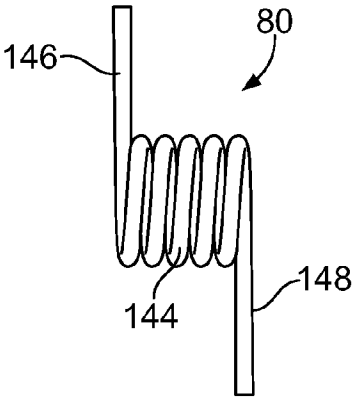
FIG. 16 is a side elevational view of a spring which forms part of the clamping assembly.
Figure 13:
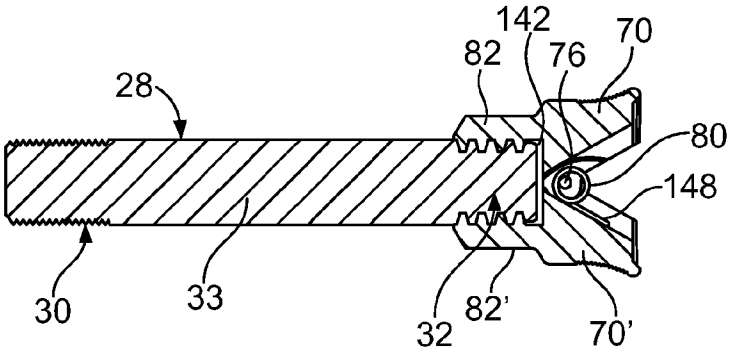
FIG. 13 is a cross-sectional view of the clamping assembly and the draw stud.
Figure 15:
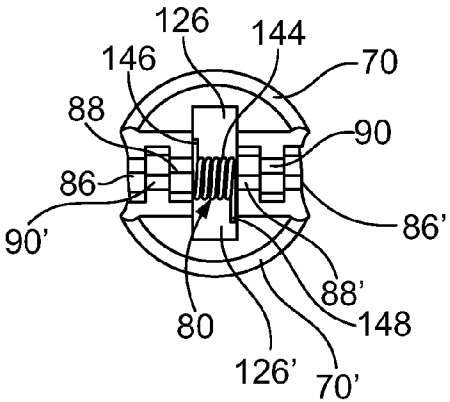
FIG. 15 is an end elevational view of the clamping assembly.

A clamping assembly 20 for driving a knockout punch assembly 22 is provided. The knockout punch assembly 22 includes a die 24 and a punch 26, see FIG. 5. The clamping assembly 20 is attached to a draw stud 28 to quickly and easily secure the punch 26 onto the draw stud 28, see FIG. 1.

Figure 2:
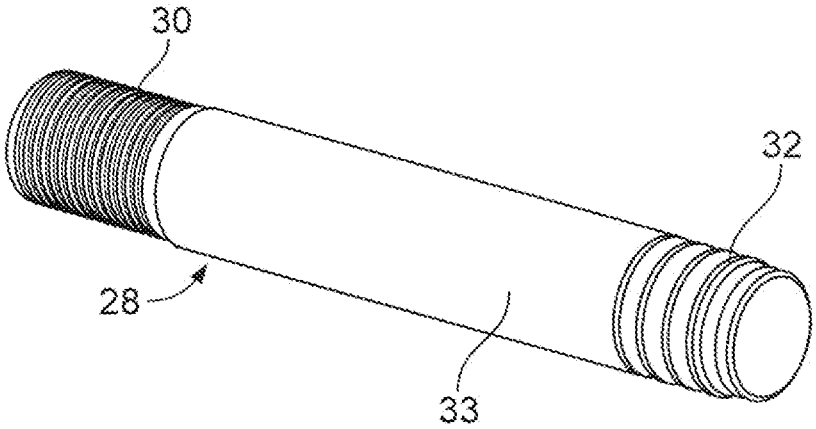
FIG. 2 is a perspective view of the draw stud.
Figure 3:
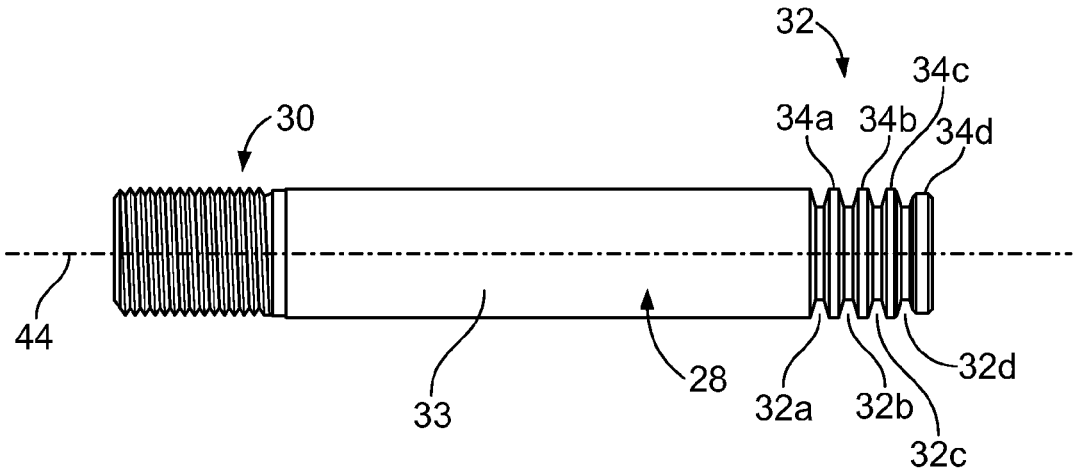
FIG. 3 is a side elevational view of the draw stud.
Figure 4:
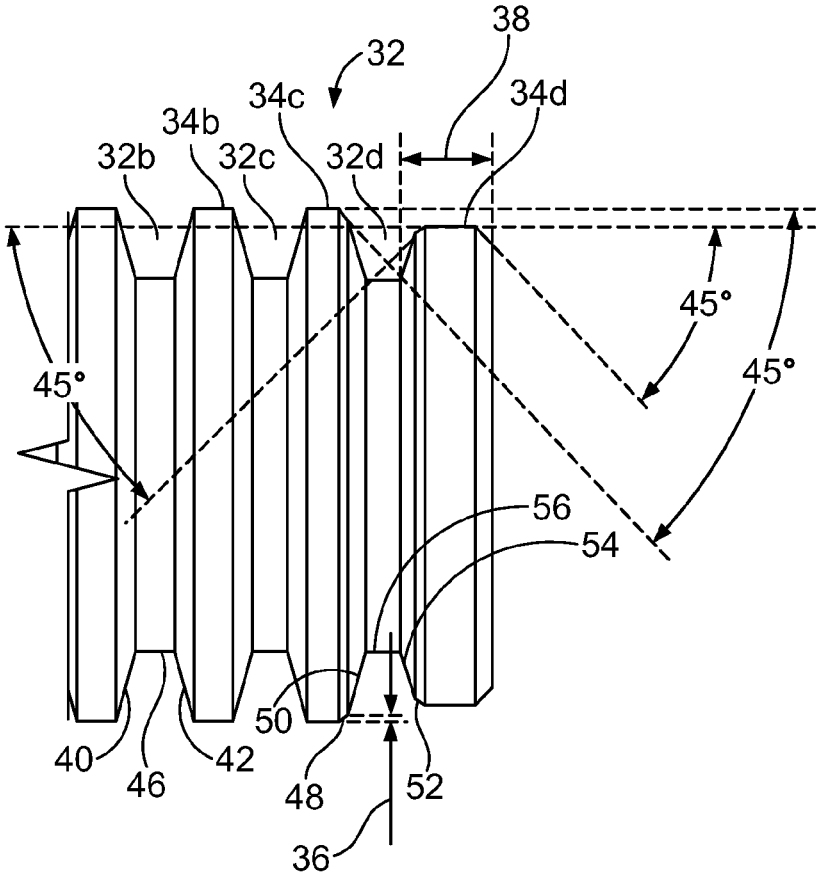
FIG. 4 is an enlarged side elevational view of an end portion of the draw stud.

The draw stud 28, FIGS. 2-4, is an elongated cylinder having a conventional thread form 30 (such as a helix) formed on one end thereon and a grooved end 32 formed from a plurality of alternating annular grooves 32*a*, 32*b*, 32*c*, 32*d* and lands 34*a*, 34*b*, 34*c*, 34*d* formed on the other end thereof. The portion 33 of the draw stud 28 between the threaded end 30 and the grooved end 32 is unthreaded.

The grooves 32 are separated from each other by the lands 34*a*, 34*b*, 34*c*. The lands 34*a*, 34*b*, 34*c* have the same outer diameter as the unthreaded portion 33 of the draw stud 28. The land 34*d* at the end of the draw stud 28 which is rearward of the rearwardmost groove 32*d* has a reduced diameter (shown as dimension 36) relative to the lands 34*a*, 34*b*, 34*c* forwardly thereof and the unthreaded portion 33 of the draw stud 28 for reasons described herein. In addition, land 34*d* has a length which is greater (shown as dimension 38) than lands 34*a*, 34*b*, 34*c* for reasons described herein. Each groove 32*a*, 32*b*, 32*c* has forward and rearward sections 40, 42 which taper from the respective adjacent lands (for example between land 34*a* and land 34*b*) at an angle relative to a centerline 44 of the draw stud 28, and a middle section 46 which is parallel to the centerline 44 of the draw stud 28. Each middle section 46 has the same diameter. Groove 32*d* has a first forward section 48 which tapers from land 34*c* at an angle, for example 45°, relative to the centerline 44 of the draw stud 28, a second forward section 50 which tapers from first forward section 48 at an angle relative to the centerline 44 of the draw stud 28, a first rearward section 52 which tapers from land 34*d* at an angle, for example 45°, relative to the centerline 44 of the draw stud 28, a second rearward section 54 which tapers from first rearward section 52 at an angle relative to the centerline 44 of the draw stud 28, and a middle section 56 which is parallel to the centerline 44 of the draw stud 28. The middle section 56 has the same diameter as middle sections 46.

The die 24 is conventionally formed and includes a base wall 58 and a circular side wall 60 extending from the outer perimeter of the base wall 58. A recess (not shown) is provided by the inner surface of the side wall 60 and the base wall 58, and the recess is in communication with a central passageway 62 extending through the base wall 58. The central passageway 62 has a diameter which is slightly greater than the diameter of the unthreaded portion 33 of the draw stud 28.

The punch 26 includes a circular wall 64 which has a cutting/punching edge 66 provided on an end thereof. A central passageway 68 is provided through the center of the wall 64 and has a diameter which is slightly greater than the diameter of the unthreaded portion 33 of the draw stud 28. An end of the central passageway 68 opposite to the end of the wall 64 which has the cutting/punching edge 66 provided thereon, has a chamfer 72.

The clamping assembly 20 includes a pair of jaws 70, 70', a pair of cylindrical roll pins 74, 76 engaged with the jaws 70, 70', and a torsion spring 80 mounted on the pins 74, 76 and between the jaws 70, 70'. The clamping assembly 20 is attached to the grooved end 32 of the draw stud 28 as described herein to quickly and easily secure the punch 26 onto the draw stud 28. The jaws 70, 70' of the clamping assembly 20 are identically formed. Therefore, only one jaw 70 is described and the other jaw 70' is shown with like reference numerals, but having a prime with the reference number.

The jaw 70 is formed from a nose 82, a grip 84 extending from the nose 82, and ears 86, 88, 90 which extend downwardly from the grip 84.

The nose 82 is defined by a front surface 92, a rear end 94 which is parallel to the front surface 92, an outer surface 96 extending between the front surface 92 and the rear end 94, and an inner surface 98 extending between the front surface 92 and the rear end 94. The front surface 92 has a taper 100 at its outermost corner which transitions the front surface 92 to the outer surface 96. The outer surface 96 is arcuate. The inner surface 98 has first and second sections 102, 104 and a central arcuate section 106 extending between the first and second sections 102, 104. The first and second sections 102, 104 are planar with each other and are generally perpendicular to the front surface 92.

The central arcuate section 106 has a plurality of alternating grooves 112, 112*a*, 112*b*, 112*c*, 112*d* and lands 114*a*, 114*b*, 114*c*, 114*d* provided thereon. Land 114*a* on the jaw 70 complements the shape of groove 32*a* on the draw stud 28; land 114*b* on the jaw 70 complements the shape of groove 32*b* on the draw stud 28; land 114*c* on the jaw 70 complements the shape of groove 32*c* on the draw stud 28; and land 114*d* on the jaw 70 complements the shape of groove 32*d* on the draw stud 28. Groove 112 on the jaw 70 complements the shape of the end of the unthreaded portion 33 on the draw stud 28; groove 112*a* on the jaw 70 complements the shape of land 34*a* on the draw stud 28; groove 112*c* on the jaw 70 complements the shape of land 34*c* on the draw stud 28; and groove 112*d* on the jaw 70 generally complements the shape of land 34*d* on the draw stud 28. Groove 112*d* is larger than land 34*d* such that a space is provided between the groove 112*d* and the land 34*d*.

The grip 84 is defined by a front end 116 which extends from the rear end 94 of the nose 82, a rear surface 118 which is parallel to the front surface 92 of the nose 82, an outer surface 120 extending between the front end 116 and the rear surface 118, and an inner surface 122 extending between the front end 116 and the rear surface 118. The outer surface 120 is arcuate and preferably has a plurality of ridges 121 provided thereon to enable a user to easily grip the grip 84. The inner surface 122 is angled (shown at dimension 124) relative to the plane in which the first and second sections 102, 104 of the nose 82 are provided, preferably at an angle of 30°. At the midpoint of the inner surface 122, a slot 126 extends a predetermined distance from the rear surface 118. As a result, a first section 128 of the inner surface 122 is defined on one side of the slot 126, and a second section 130 of the inner surface 122 is defined on the other side of the slot 126.

Ears 86 and 88 extend downwardly from the first section 128 and are spaced apart from each other. Ear 90 extends downwardly from the second section 130. The ears 86, 88, 90 extend downwardly from the nose 82 and the grip 84. Each ear 86, 88, 90 has an arcuate outer surface and an aperture 132, 134, 136 which extends therethrough. The apertures 132, 134, 136 are aligned with each other. Predetermined ones of the apertures can be larger than the remaining apertures. The area 139 of the inner surface 122 between the pair of spaced apart ears 86, 88 is curved to conform to the shape of the ear 90' on the other jaw 70'. The areas 138, 140 of the inner surface 122 on either side of ear 90 are curved to conform to the shape of the pair of spaced apart ears 86', 88' on the other jaw 70'.

The jaws 70, 70' are meshed together such that the first and second sections 102, 104 of the nose 82 of jaw 70 seat against the first and second sections of the nose 82' of jaw 70', and the inner surfaces 122, 122' of the grips 84, 84' face each other. A centerline 160 is formed between the mated jaws 70, 70'. Ear 90 on jaw 70 seats between ears 86', 88' on jaw 70' and abuts against the curved area (identical to area 139) on jaw 70, and ear 90' on jaw 70' seats between ears 86, 88 on jaw 70 and abuts against the curved area 139 on jaw 70. The apertures 132, 134, 136 (and those provided through ears 86', 88' 90') through ears 86, 90', 88, 88', 90, 86' align with each other. The slots 126, 126' align with each other. When the jaws 70, 70' are meshed, a socket 142 is provided between the noses 82, 82' into which the annular grooves 32*a*, 32*b*, 32*c* and lands 34*a*, 34*b*, 34*c*, 34*d* are seated as discussed herein.

As stated earlier, lands 114*a* complement the shape of groove 32*a*, lands 114*b* complement the shape of groove 32*b*, lands 114*c* complement the shape of groove 32*c*, and lands 114*d* complement the shape of groove 32*d*; and grooves 112 complement the shape of the end of the unthreaded portion 33 on the draw stud 28, grooves 112*a* complement the shape of land 34*a*, grooves 112*c* complement the shape of land 34*c*, and grooves 112*d* generally complements the shape of land 34*d*. The lands 114*a*, 114*b*, 114*c*, 114*d* on each jaw 70, 70' fall along the same radius from the centerline 160. Each groove 112, 112*a*, 112*b*, 112*c*, 112*d* has forward and rearward sections which taper from the respective adjacent lands (for example between land 114*a* and land 114*b*) at an angle relative to the centerline 160, and a middle section which is parallel to the centerline 160. The middle section of each groove 112, 112*a*, 112*b*, 112*c*, 112*d* on each jaw 70, 70' falls along the same radius from the centerline 160. In addition, groove 112*d* has a length which is greater than grooves 112, 112*a*, 112*b*, 112*c*.

The torsion spring 80 has a central coiled section 144, a first straight section 146 extending from one end of the coiled section 144 and a second straight section 148 extending from the opposite end of the coiled section 144. The central coiled section 144 seats between the ears 88, 88' when the jaws 70, 70' are meshed together. The first straight section 146 seats within the slot 126 in jaw 70, and the second straight section 148 seats within the slot 126' in jaw 70'.

Pin 74 is mounted so that it extends through ears 86, 90', 88 and extends into the central coiled section 144 of the torsion spring 80. Pin 74 is inserted first into the aperture in ear 86 and is hammered into place until it is flush with the outer surface of ear 86. Pin 74 is press fit with at least one of the ears 86, 90', 88. Pin 76 is mounted so that it extends through ears 86', 90, 88' and extends into the central coiled section 144 of the torsion spring 80. Pin 76 is inserted first into the aperture in ear 86' and is hammered into place until it is flush with the outer surface of ear 86'. Pin 76 is press fit with at least one of the ears 86', 90, 88'. Alternatively, a single pin can be used. The jaws 70, 70' can pivot around the pins 74, 76 as described herein.

In its normal condition, the torsion spring 80 biases the jaws 70, 70' into a closed position, wherein the noses 82, 82' press against each other. The jaws 70, 70' can be moved to an open position by a user pressing on the outer surfaces 120 of the grips 84, 84'. When the grips 84, 84' are pressed, the force of the torsion spring 80 is overcome such that the inner surfaces 122, 122' of the grips 84, 84' move toward each other, and thus, the noses 82, 82' move away from each other.

Once assembled, the clamping assembly 20 can be used with the draw stud 28 in the following way. First, the user drills a pilot hole 150 in a workpiece 152. The threaded end 30 of the draw stud 28 is threaded into an associated ram (not shown.) The draw stud 28 is passed through the die 24, then through the pilot hole 150 to prepare for punching a hole. Second, the punch 26 is inserted over the annular grooves 32*a*, 32*b*, 32*c*, 32*d* and lands 34*a*, 34*b*, 34*c*, 34*d* and is positioned such that its cutting/punching edge 66 faces the workpiece 152. Third, the clamping assembly 20 is moved to its open position and the annular grooves 32*a*, 32*b*, 32*c*, 32*d* and lands 34*a*, 34*b*, 34*c*, 34*d* of the draw stud 28 are inserted therein. The pressure against the grips 84, 84' is then removed which causes the torsion spring 80 to return to its natural position and close the clamping assembly 20. The grooves 112*a*, 112*b*, 112*c*, 112*d* and lands 114*a*, 114*b*, 114*c*, 114*d* on the clamping assembly 20 intermesh with the annular grooves 32*a*, 32*b*, 32*c*, 32*d* and lands 34*a*, 34*b*, 34*c*, 34*d* on the draw stud 28 to securely attach the clamping assembly 20 to the draw stud 28. Since the land 34*d* has a length which is greater than the remaining lands 34*a*, 34*b*, 34*c*, the draw stud 28 cannot be inserted improperly since the lands 34*a*, 34*b*, 34*c*, 34*d* on the draw stud 28 must match into the corresponding grooves 112*a*, 112*b*, 112*c*, 112*d* in the clamping assembly 20 in order for the clamping assembly 20 to close. The chamfer 72 on the punch 26 engages the taper 100 of the noses 84, 84'. This ensures full engagement of the jaws 70, 70' with the draw stud 28 throughout the punching cycle. Finally, the user actuates the ram which causes the draw stud 28, the clamping assembly 20 and the knockout punch 26 to move relative to the die 24 causing the knockout punch 26 to engage the workpiece 152 and create a hole 154. The grooves 112*a*, 112*b*, 112*c*, 112*d* and lands 114*a*, 114*b*, 114*c*, 114*d* on the jaws 70, 70' and the annular grooves 32*a*, 32*b*, 32*c*, 32*d* and lands 34*a*, 34*b*, 34*c*, 34*d* on the draw stud 28 distribute the load, which permits punching forces as high as 12,000 pounds.

Once the hole 154 has been created, the user can easily and quickly disengage the clamping assembly 20 from the draw stud 28 by moving the clamping assembly 20 to its open position. The punch 26 then is removed from the draw stud 28, the draw stud 28 removed from the workpiece 152, and the draw stud 28 removed from the ram and die 24. Since land 34*d* has a smaller outer diameter than the remaining lands 34*a*, 34*b*, 34*c*, this provides for a relief which overcomes the interference that would otherwise be encountered when the jaws 70, 70' are rotated to the open position when the clamping assembly 20 is removed from the draw stud 28.

A variety of punch/die sizes can be used with the clamping assembly 20. The axial length of the punches compliments the depth of the dies such that a single draw stud length works with all punch/die combinations. This minimizes the part count (one draw stud) and avoids the need for spacers. By optimizing the length of the draw stud for all punch/die combinations, the punching time is also minimized.

While a preferred embodiment of the present invention is shown and described, it is envisioned that those skilled in the art may devise various modifications of the present invention without departing from the spirit and scope of the appended claims.

What is claimed:

1. An assembly comprising:

a draw stud formed as an elongated cylinder having first and second opposite ends, a conventional thread formed on said first end of said draw stud and a plurality of alternating grooves and lands formed on the second end of said draw stud, said grooves and lands being at least semi-annular, a portion of said draw stud between said ends being unthreaded;

a first jaw having an outer surface and an inner surface, said inner surface of said first jaw having a plurality of alternating semi-annular grooves and lands formed thereon, a second jaw having an outer surface and an inner surface, said inner surface of said second jaw having a plurality of alternating semi-annular grooves and lands formed thereon, said jaws being pivotable relative to each other around a pivot;

a spring provided between said first and second jaws, said spring biasing said jaws into a closed position in which said jaws are clamped onto the draw stud and the alternating grooves and lands formed on the first jaw mesh with said alternating grooves and lands formed on the draw stud and the alternating grooves and lands formed on the second jaw mesh with the alternating grooves and lands formed on the draw stud;

a die mounted on said draw stud; and a punch mounted on said draw stud.

2. The assembly of claim 1, wherein said outer surface of each said jaw has a gripping surface provided thereon.

3. The assembly of claim 1, wherein said first jaw includes at least one ear and said second jaw includes at least one ear, said at least one ear of said first jaw engaging with said at least one ear of said second jaw, and said pivot comprises at least one pin inserted through said at least one ear of the first jaw and said at least one ear of said second jaw.

4. The assembly of claim 1, wherein a centerline is defined by said draw stud, a bottom of each said groove on said draw stud falls on the same radius from said centerline with respect to the other grooves on the draw stud.

5. The assembly of claim 4, wherein said lands on said draw stud are defined by a rearwardmost land and a remainder of said lands, the rearwardmost land being closest to said second end of said draw stud and having a length defined parallel to said centerline which is longer than a length of each of the remainder of said lands.

6. The assembly of claim 5, wherein said rearwardmost land has an outer dimension which is different from the remainder of said lands.

7. The assembly of claim 1, wherein a centerline is defined by the mated first and second jaws, and wherein each said land on said jaws has forward and rearward sections which taper from the respective adjacent lands on said jaws at an angle relative to the centerline, and each land on the jaws further has a middle section which is parallel to the centerline.

8. The assembly of claim 1, wherein a centerline is defined by the mated first and second jaws, said grooves on each jaw are defined by a rearwardmost groove and a remainder of said grooves, each said rearwardmost groove being closest to the pivot, each said rearwardmost groove having a length defined parallel to said centerline defined by the mated first and second jaws which is longer than a length of each of the remainder of said grooves on said respective jaw, the grooves on each said jaw falling along the same radius from said centerline defined by the mated first and second jaws, each said land on said jaws having forward and rearward sections which taper from the respective adjacent lands on said jaws at an angle relative to said centerline defined by the mated first and second jaws, and each land on the jaws further having a middle section which is parallel to the centerline defined by the mated first and second jaws, and wherein a centerline is defined by said draw stud, said lands on said draw stud are defined by a rearwardmost land and a remainder of said lands, the rearwardmost land of said draw stud being closest to said second end of the draw stud and having a length defined parallel to said centerline defined by said draw stud which is longer than a length of each of the remainder of said lands on said draw stud, the rearwardmost land of said draw stud defining a diameter which is less than a diameter of each of the remainder of said lands on said draw stud, the grooves on said draw stud falling along the same diameter, each said groove on said draw stud having forward and rearward sections which taper from the respective adjacent lands on said jaws at an angle relative to said centerline defined by the draw stud, and each groove on the draw stud further having a middle section which is parallel to the centerline defined by said draw stud.

9. The assembly of claim 1, wherein said punch includes a chamfer which engages with a taper on said jaws.

10. The clamping assembly of claim 1, wherein each said jaw has a front surface and a rear surface, said front surface being proximate to said alternating grooves and lands of each said jaw, and further including a taper on each said front surface.

11. The assembly of claim 1, wherein a centerline is defined by the mated first and second jaws, said grooves on each said jaw are defined by a rearwardmost groove and a remainder of said grooves, each said rearwardmost groove being closest to the pivot, each said rearwardmost groove having a length defined parallel to said centerline defined by the mated first and second jaws which is longer than a length of each of the remainder of said grooves on said respective jaw, and wherein a centerline is defined by said draw stud, said lands on said draw stud are defined by a rearwardmost land and a remainder of said lands, the rearwardmost land of said draw stud being closest to said second end of the draw stud and having a length defined parallel to said centerline defined by said draw stud which is longer than a length of each of the remainder of said lands on said draw stud.

12. The assembly of claim 1, wherein a centerline is defined by the mated first and second jaws, a centerline is defined by the draw stud, the grooves on each said jaw falling along the same radius from said centerline defined by the mated first and second jaws, the grooves on each jaw are defined by a rearwardmost groove and a remainder of the grooves, each rearwardmost groove being closest to the pivot, the lands on the draw stud are defined by a rearwardmost land and a remainder of the lands, the rearwardmost land of the draw stud being closest to the second end of the draw stud, and the rearwardmost land of said draw stud defining a diameter which is less than a diameter of each of the remainder of said lands on said draw stud, the grooves on said draw stud falling along the same diameter.

13. The assembly of claim 1, wherein a centerline is defined by the mated first and second jaws, a centerline is defined by the draw stud, each said land on said jaws having forward and rearward sections which taper from the respective adjacent lands on said jaws at an angle relative to said centerline defined by the mated first and second jaws, and each land on the jaws further having a middle section which is parallel to the centerline defined by the mated first and second jaws, and each said groove on said draw stud having forward and rearward sections which taper from the respective adjacent lands on said jaws at an angle relative to said centerline defined by said draw stud, and each groove on the draw stud further having a middle section which is parallel to the centerline defined by said draw stud.

14. The assembly of claim 1, wherein a centerline is defined by the mated first and second jaws, a centerline is defined by the draw stud, the grooves on each said jaw falling along the same radius from said centerline defined by the mated first and second jaws, each said land on said jaws having forward and rearward sections which taper from the respective adjacent lands on said jaws at an angle relative to said centerline defined by the mated first and second jaws, and each land on the jaws further having a middle section which is parallel to the centerline defined by the mated first and second jaws, the lands on the draw stud are defined by a rearwardmost land and a remainder of the lands, the rearwardmost land of the draw stud being closest to the second end of the draw stud, the rearwardmost land of said draw stud defining a diameter which is less than a diameter of each of the remainder of said lands on said draw stud, the grooves on said draw stud falling along the same diameter, and each said groove on said draw stud having forward and rearward sections which taper from the respective adjacent lands on said jaws at an angle relative to said centerline defined by said draw stud, and each groove on the draw stud further having a middle section which is parallel to the centerline defined by said draw stud.

15. The clamping assembly of claim 1, wherein the grooves and lands formed on said draw stud are annular.

* * * * *